US005795538A

United States Patent [19]

Abukawa et al.

[11] Patent Number: 5,795,538

[45] Date of Patent: Aug. 18, 1998

[54] APPARATUS FOR STEEL HARDENING AND PROCESS THEREFOR

[75] Inventors: Fumitaka Abukawa; Hitoshi Goi; Masahiko Watanabe; Shin Kurasawa; Hirofumi Kamisugi, all of Yokohama; Keishichi Namba, deceased, late of Yokohama, all of Japan, by Masako Namba, legal representative

[73] Assignee: Dowa Mining Co., Ltd., Tokyo, Japan

[21] Appl. No.: 704,812

[22] Filed: Aug. 28, 1996

Related U.S. Application Data

[63] Continuation-in-part of Ser. No. 185,694, Jan. 24, 1994, abandoned.

[30] Foreign Application Priority Data

Jan. 27, 1993 [JP] Japan ..... 5-31456
Feb. 17, 1993 [JP] Japan ..... 5-51446

[51] Int. Cl.[6] ..... C21D 1/10

[52] U.S. Cl. ..... 266/46; 266/131; 266/130

[58] Field of Search ..... 266/46, 130, 131, 266/132, 44

[56] References Cited

U.S. PATENT DOCUMENTS 2,638,909 5/1953 Hiatt et al. ..... 266/131
3,684,263 8/1972 Genrich ..... 266/132

*Primary Examiner*—Scott Kastler
*Attorney, Agent, or Firm*—Bauer & Schaffer

[57] ABSTRACT

In a method for quenching metal parts, a quenching chamber is provided in which the quenching oil is continuously supplied from below the steel parts and circulated upward through the parts in a laminar flow. The circulation is accomplished by feeding the quenching oil onto the bottom of the quenching chamber of an auxiliary chamber surrounding it.

13 Claims, 8 Drawing Sheets

APPARATUS FOR STEEL HARDENING AND PROCESS THEREFOR

RELATED APPLICATION

The present application is a continuation-in-part of U.S. patent application Ser. No. 08/185,694 filed on Jan. 24, 1994, now abandoned.

BACKGROUND OF THE INVENTION

This invention relates to a method for hardening steel and to the apparatus therefor as used in conjunction with various heat treatment processes such as carburizing, carbonitriding and nitriding and the like.

Hardening is performed in order to improve the strength of the steel. There are, however, problems in the known methods, whereby changes in shape and distortions in measurement easily occur in the steel parts during the hardening process. Therefore, in order to prevent such changes of the shape and distortion of measurement, it is essential to cool quickly the critical zone and then slowly the dangerous zone. Ordinarily, the martempering or time quenching is utilized as the hardening method, and salt or high temperature quenching oil is utilized as the cooling agent, particularly for steel parts and the like, in which any change of the shape and distortion of measurement are unacceptable.

In the martempering process, steel parts maintained at the hardening temperature are dipped into a salt bath or a high temperature quenching oil bath maintained at temperature higher than the Ms point of the steel parts to be treated. The temperature is maintained immediately above the Ms point (martensitic transformation temperature) for a given time, and when the steel parts reach a predetermined temperature, the steel parts are picked up from the bath and cooled down so as to make the martensitic transformation. In case the time quenching is simultaneously utilized, the transformation is obtained by dipping the steep parts in a secondary bath maintained at a temperature lower than the Ms point.

In the aforementioned ordinary hardening process, the part of steel subjected to the martempering is the part carburized at approximately 0.8% C (carbon) and is limited to total carburization of only the outer surface.

The inventors of the present invention found that mixing of the quenching oil by mixing blades, which is ordinarily carried out in order to cool down the steel parts dipped into the quenching bath to the predetermined uniform temperature, causes a change of the shape and a distortion of measurement.

That is, when the mixing blades are rotated in the quenching oil, air is sucked into quenching oil as a result of the turbulence from the rotary shaft of the mixing blades. This air is mixed during the circulation of the quenching oil and forms bubbles in the quenching oil. The bubbles are diffused in the quenching oil by the mixing blades and adhere on the surface of the steel parts. This causes uneven cooling of the steel parts, resulting in variability in the treated layers, which results in a change of the shape and a distortion of measurement. This phenomenon was particularly significant when the mixing blades were rotated in high speed for quick cooling because a large number of bubbles are formed in the quenching oil.

Further, the ordinary quenching bath is constructed unnecessarily large in order to install the mixing blades in an attempt at evenly mixing the quenching oil and to provide the desired circulation path of the quenching oil. This frequently results in variations in the flow of quenching oil and in temperature and, according to overlaying condition and the shape of the steel parts to be treated, staying of the quenching oil occurs. In some cases, this causes uneven cooling of the steel parts which results in variation of the treated layer, a change of the shape, a distortion of measurement and the like.

In consequent air cooling processes, the environment surrounding the steel parts such as air temperature, humidity, wind and the like are factors which cause variation of the treated layer, a change of the shape, a distortion of measurement and the like.

Further, in the time quenching method, the time difference in dipping into the secondary bath—that is, the dipping time difference in the direction from the top to bottom has caused a variation of cooling time and cooling rate between lots since it takes a relatively long time for dipping by a cylinder or a crane during lot dipping.

Therefore, at present the prevention of variations such as a change of the shape and a distortion of measurement due to the transformation at the inner part of steel parts maintained at lower carbon content than 0.8% C (carbon) depends on experiential overlaying method or improvement of an overlaying jig.

BRIEF SUMMARY OF THE INVENTION

The present invention was made in consideration of the aforementioned circumstances, and the first object is to provide a hardening method and apparatus which does not form bubbles in quenching oil during hardening. For that purpose, in the present invention, quenching oil is continuously supplied below the steel parts within the quenching space. Just as when a river flows into the ocean, the quenching space acts with a calming, pooling effect on the supplied quenching oil. The quenching oil present at the bottom of the quenching space is displaced through volume displacement such that it rises upwards as a layer. Therefore, the quenching oil in the quenching space is circulated upwards through volume displacement in a laminar flow without using mixing blades unlike the conventional method. Laminar flow being a non-turbulent flow of a viscous fluid, such as the quenching oil in successive upwardly moving layers (see page 674, Webster's II, New Riverside University Dictionary, 1984, Houghton Mifflin Co.).

The present invention prevents any cooling variation due to uneven flow, stagnation and the like of quenching oil which may occur when the size of said quenching bath is large. Therefore, in the present invention, the smallest quenching space as is possible is provided so as to surround the up and down path for an elevator located in the quenching bath, flowing quenching oil upward by supplying the oil from the bottom of the steel parts carried down by the elevator into said quenching space and cooling down the steel parts during overflow of the quenching oil from the top of the quenching space into the quenching bath.

Further, the apparatus of the present invention is constructed so as to provide a quenching space surrounding the up and down path of an elevator in a quenching bath so that the upper end of the quenching space is lower than the upper end of the quenching bath and the quenching space itself is separated from the quenching bath and the quenching oil is supplied at the bottom of said quenching space.

BRIEF DESCRIPTION OF THE INVENTION

DETAILED DESCRIPTION OF THE INVENTION

Figure 1:
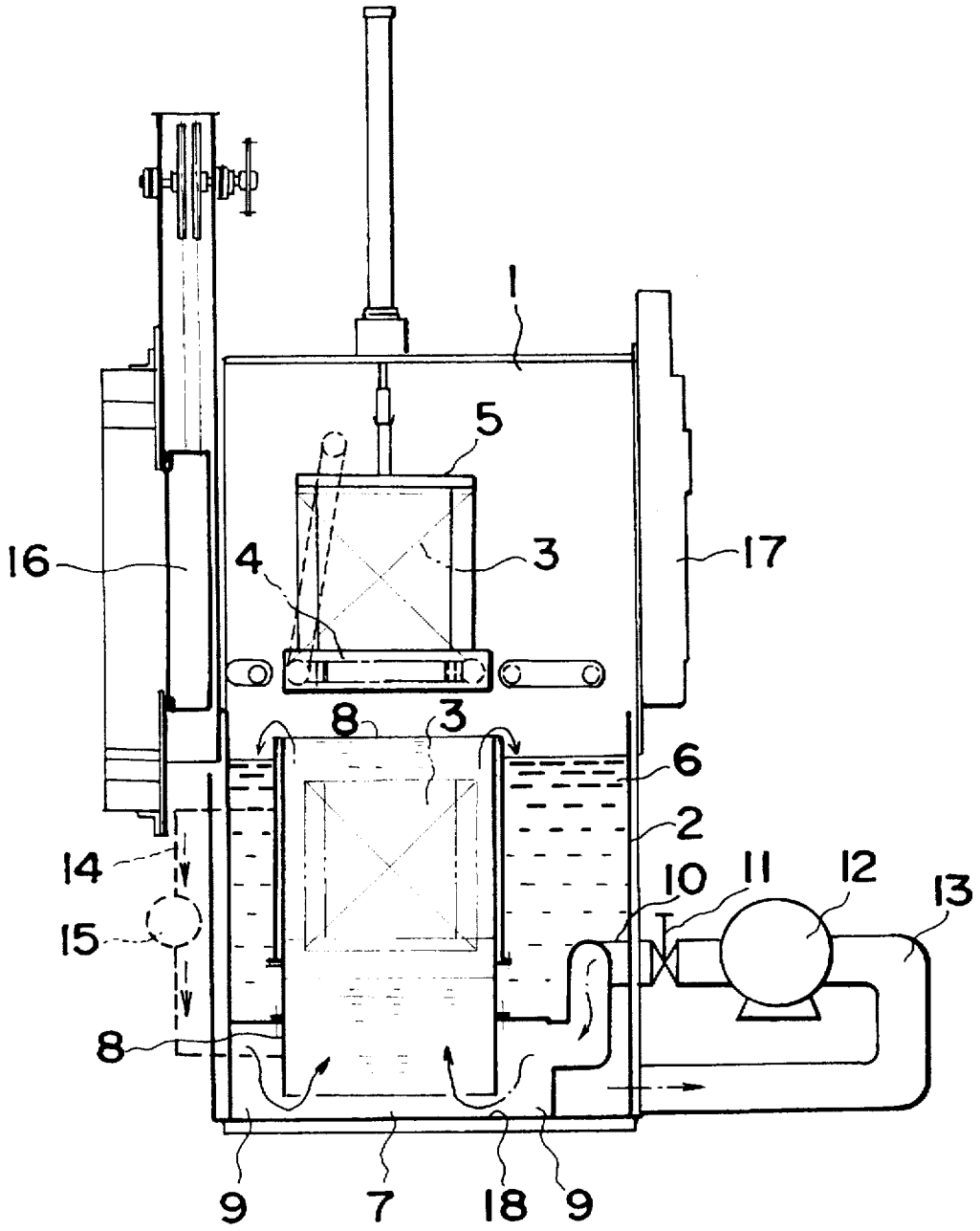
FIG. 1 is a diagram showing one embodiment of apparatus according to the present invention.

The apparatus as seen in FIG. 1 comprises a reservoir tank 2, above which is mounted an enclosure forming a vestibule 1 for the introduction and removal of steel parts 3 to be treated. An elevator 5 having a transfer apparatus 4 is mounted to carry steel parts 3 from the vestibule into the tank 2 after having undergone carburizing treatment or the like. Numeral 6 in the drawings is the quenching oil comprising the cooling media.

A quenching chamber 8 formed by a hollow tubular shaft open at its upper end is mounted in the tank 2 and is defined by a quenching chamber into which the elevator 5 is moved and which surrounds the elevator as it carries the steel parts 3 in an up and down path. The upper end of the chamber 8 is lower than the upper end of the tank 2 and the quenching oil 6 is supplied to the bottom of the quenching chamber 8.

In the embodiment shown in FIG. 1, the chamber 8 is arranged to provide a narrow space 7 between the bottom wall 18 of the reservoir tank 2 and the lower edge of the tubular quenching chamber 8. The chamber 8 is constructed so as to be as small in cross section as possible but large enough to allow up and down movement of said elevator 5. The space thus arranged creates a restrictive passage for the flow of the oil creating within the chamber 8 a laminar flow of oil upwardly through the chamber.

In this manner, quenching oil 6 can flow quickly upward, and the cooling effect can be enhanced as explained in detail later.

Further, in this embodiment, an auxiliary chamber 9 is provided at the lower end of the chamber 8 so as to enclose the space 7 together with the bottom wall 18 of the reservoir tank 2 while also separating the space 7 from the upper part of the reservoir tank 2. This auxiliary chamber 9 rests on the bottom wall 18 of the quenching tank 2 and supports the shaft forming the chamber 8.

A supply pipe 10 for delivering quenching oil 6 is connected to the auxiliary chamber 9, and a pipe 13 is provided to circulate oil to the supply pipe 10 through a flow control valve 11 and a circulating pump 12. The supply of quenching oil delivered through pipe 10 is thus independent of the reservoir of oil in the tank 2.

Preferably, the supply pipe 10 may be split into any appropriate number of outlets and separately connected to the auxiliary chamber 9 so that quenching oil is supplied evenly into the auxiliary chamber 9. Consequently, this results in an even supply of quenching oil 6 from the auxiliary chamber 9 into the quenching chamber defined by the chamber 8, resulting in further homogeneous cooling of the steel parts 3 so that a change of the shape and a distortion of measurement of the steel parts 3 is efficiently prevented.

Figure 2:
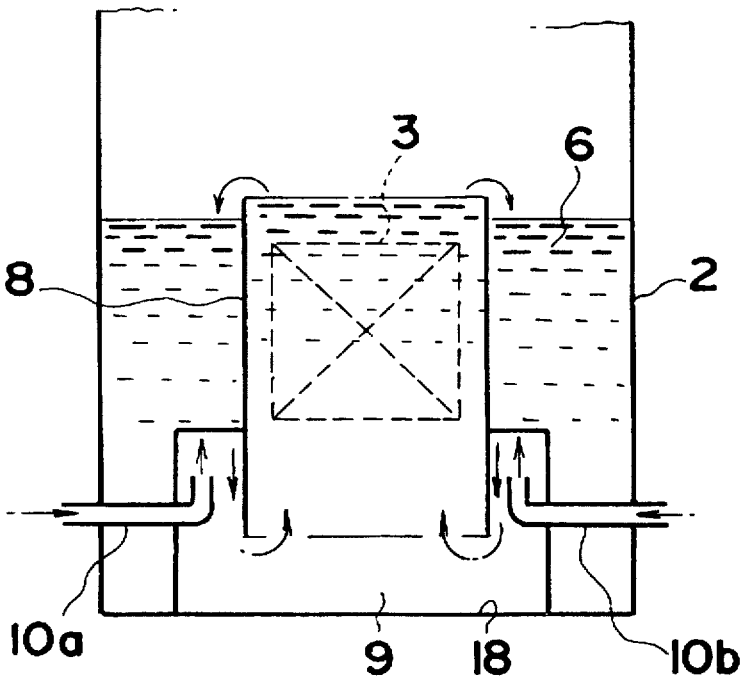
FIG. 2 is a diagram showing another embodiment of apparatus according to the present invention.
Figure 3:
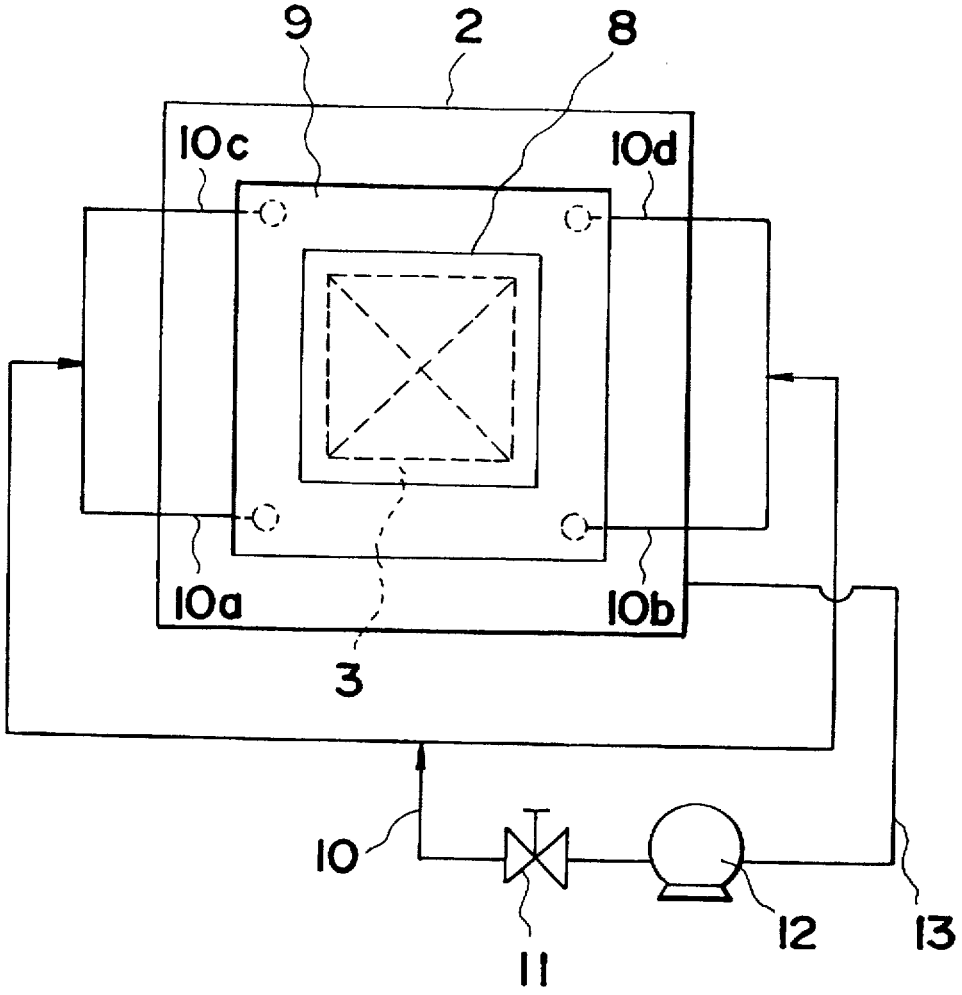
FIG. 3 is a plan drawing of FIG. 2.

This modification is schematically shown in FIGS. 2 and 3. That is, split supply pipes 10*a*, 10*b*, 10*c* and 10*d* branched from the supply pipe 10 extend from the circulating pump 12 and the flow control valve 11 and are evenly connected about the sides of the auxiliary chamber 9, which chamber 9 is located in the center of the reservoir tank 2.

Further, if the tip of each of the split supply pipes 10*a*, 10*b*, 10*c* and 10*d* are constructed so as to turn or be bent upward as shown in FIG. 2 so that the quenching oil 6 supplied is allowed to hit the ceiling of the auxiliary chamber 9, the quenching oil 6 is further homogenized and the laminar flow enhanced. As seen by the arrows, the quenching oil then flows downwardly and then upwardly into the quenching chamber 8 as a laminar flow so that the steel parts are cooled down evenly. This even and uniform cooling down of the steel parts via laminar flow prevents any change of the shape or distortion of measurement of the steel parts 3 which might otherwise occur.

In FIG. 1, numeral 14 depicts an external circulation path connecting the upper and the lower parts of the tubular shaft 8, which may be provided optionally. Midway in the circulation path a pump 15, preferably of a reciprocal type, may be provided.

This circulation path 14 and the circulation pump 15 are not shown in FIGS. 2 and 3, but it is preferable to install them also in the apparatus shown in FIGS. 2 and 3.

Further, numeral 16 in the drawings is an inlet door for the vestibule 1, and numeral 17 is an outlet door for the vestibule 1.

Figure 4:
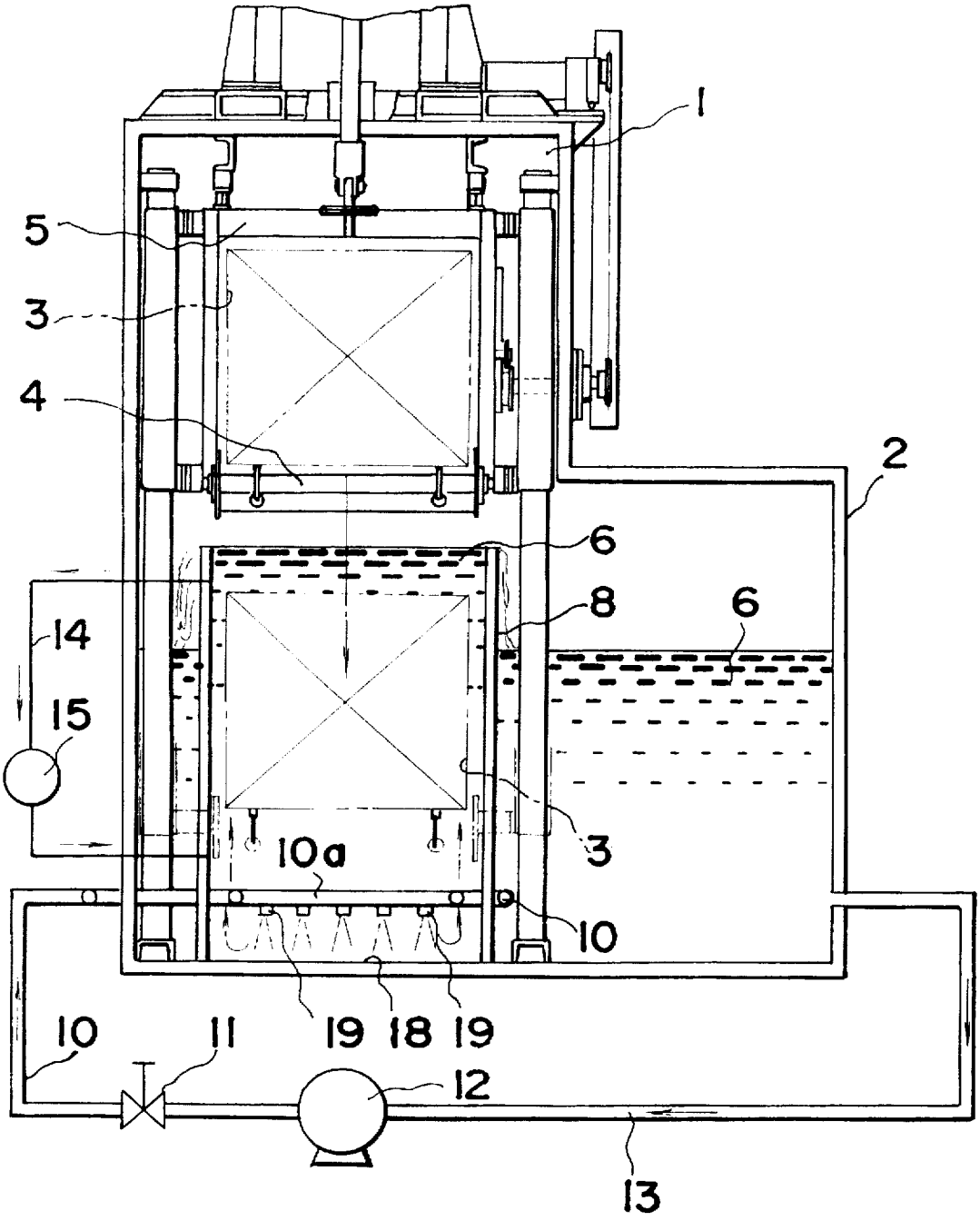
FIG. 4 is a diagram showing a third embodiment of apparatus according to the present invention.
Figure 5:
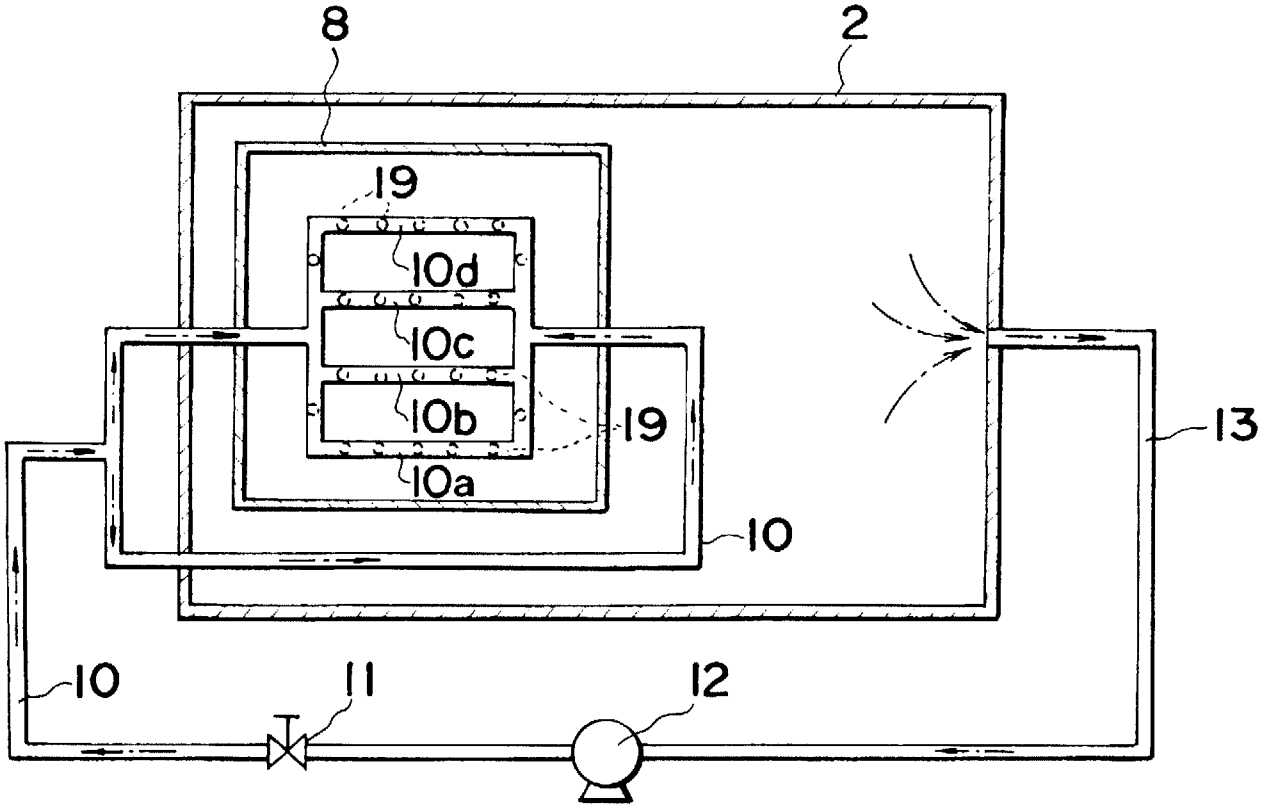
FIG. 5 is a plan drawing of FIG. 4.

FIGS. 4 and 5 show another embodiment of the present invention. The differences of this embodiment from the apparatus of the embodiments shown in FIG. 1 and the modification shown in FIGS. 2 and 3 are in the branching of the supply pipe 10 and the extension of the shaft forming chamber 8 so that it is provided with a bottom wall in common with the bottom wall of the reservoir tank. The pipe 10 within the chamber 8 is formed with a plurality of pipes 10*a*, 10*b*, 10*c* and 10*d*, each having an array of nozzles 19. The auxiliary chamber 9 is not provided.

According to this embodiment, the quenching oil 6 supplied through the supply nozzles 19 of each of the pipes 10*a*, 10*b*, 10*c* and 10*d* is allowed to hit the bottom wall 18 to create the laminar flow which then passes into the quenching chamber 8 to cool down the steel parts 3.

Figure 8:
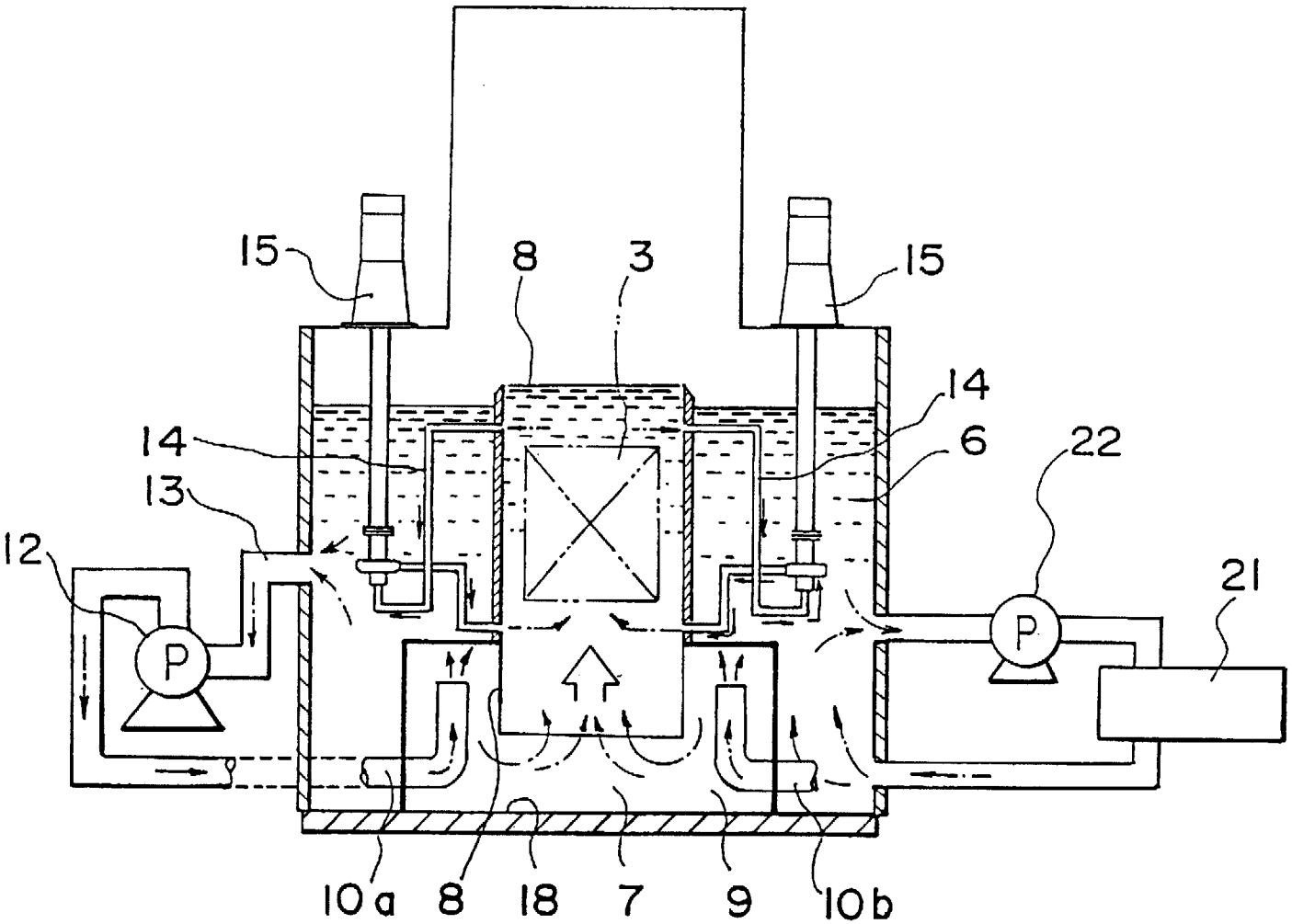
FIG. 8 is a diagram showing a fourth embodiment of apparatus according to the present invention.

In FIG. 8 another embodiment is shown in which, in addition to the recirculation of the quenching oil between the reservoir tank and the quenching chamber, a system for cooling the quenching oil is provided. The cooling system comprises a heat exchanger 21 and a pump 22. The pump withdraws oil from the reservoir tank and passes it through the heat exchange for return to the lower portion of the receiving tank.

It is noted that in the embodiment of FIG. 8 the circulating system from reservoir tank 2 to quenching chamber 8 comprising pump 12 and conduit 13 is arranged slightly differently. Also, in the system for circulating the oil within the quenching chamber 8, the conduit 14 and pump 15 are multiplied and rearranged above the reservoir tank.

In the apparatus of the embodiments shown in FIG. 1 or shown in FIGS. 2 and 3, the steel parts 3, after heat treatment such as carburizing and the like, are deposited onto the elevator 5 in the quenching vestibule 1 through the inlet door 16. Then both the elevator 5 and the steel parts 3 descend until they are dipped into quenching oil 6 in the quenching chamber 8 for hardening treatment.

The flow control valve 11 is opened before or at the same time the steel parts are dipped and the circulation pump 12 is operated. Consequently, quenching oil 6 is supplied into the auxiliary chamber 9 from the supply pipe 10. Quenching oil 6 flowing into the auxiliary chamber 9, which has a wider diameter than that of the supply pipe 10, reduces the flow rate, which is controlled to allow uniform flow into the quenching chamber from the whole area beneath the chamber 8. This quickly cools the steel parts 3 while the quenching oil flows upward. The quenching oil 6, after quickly cooling the steel parts 3, overflows from the top of the chamber 8 into the reservoir tank 2. Thus, quenching oil 6 is circulated. The aforementioned cooling process is essentially the same for the apparatus of the embodiment shown in FIGS. 4 and 5.

Figure 9:
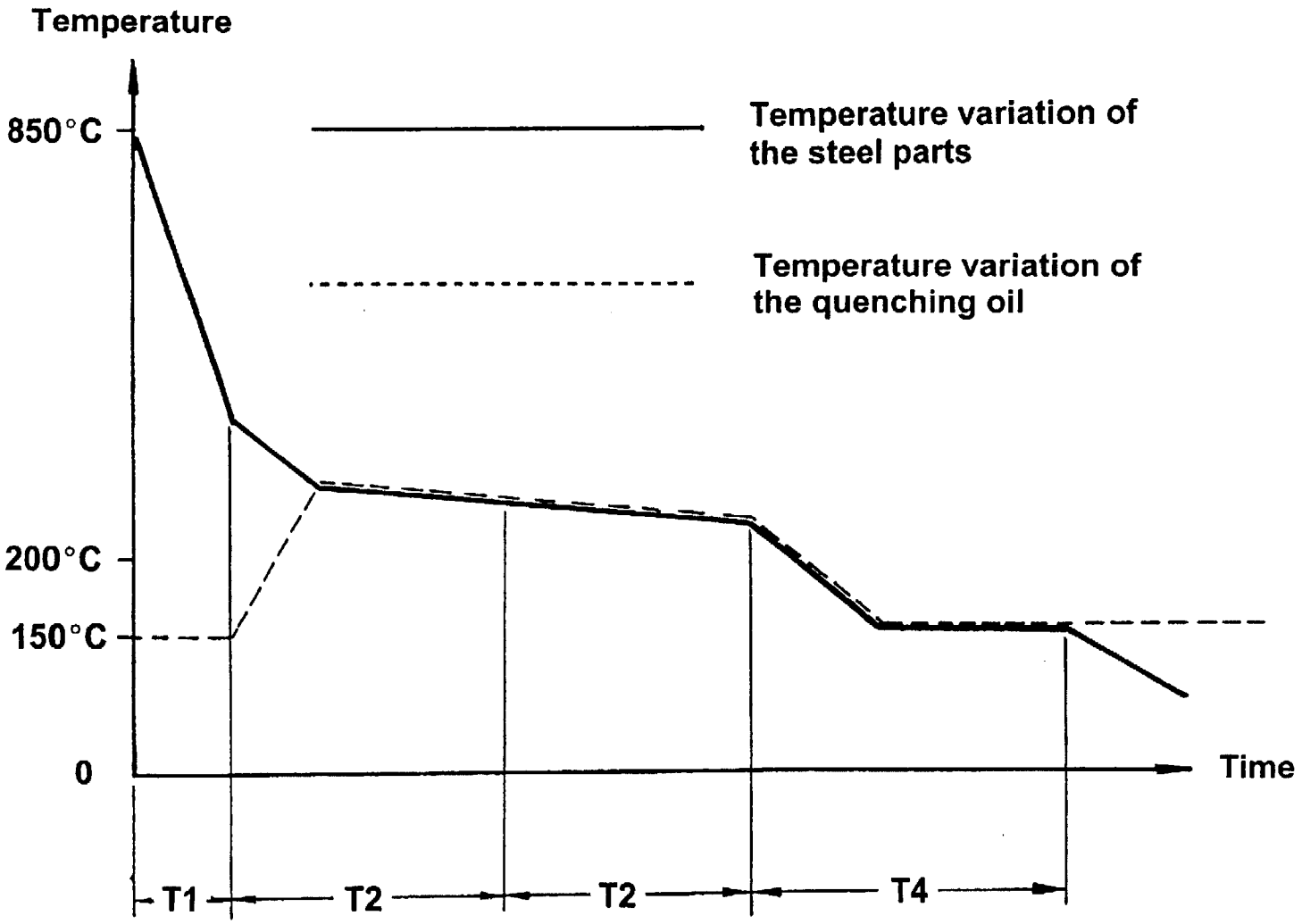
FIG. 9 is a graph, indicating temperature variations of both the steel parts and the quenching oil with the passing of time during the quenching process.

The temperature variations occurring during the present quenching process are depicted in FIG. 9 and occur as follows:

a) The quenching oil 6 is maintained at about 150° C. and supplied into the quenching chamber 8 upward from the bottom thereof through the auxiliary chamber 9 by the circulating pump 12.

b) The steel parts 3 preheated at the carburizing temperature are dipped into said quenching oil 6 by the transfer apparatus 4 and cooled down for the time T, shown in the attached drawing, then supply of the quenching oil 6 by the circulating pump 12 is stopped.

c) At this time, temperature of the quenching oil 6, which was initially at 150° C. raises near to the martensitic transformation temperature (Ms point) by heat released from the steel parts 3, then temperature between the steel parts 3 and the quenching oil 6 is almost equalized during the steady phase ($T_2$ hours) of the quenching oil 6.

d) Then the circulation pump 15 is operated for $T_3$ hours in order to minimize temperature distortion between the upper and the lower parts of the steel parts 3 and then the circulation pump 15 is stopped. The circulating pump 12 is again operated for $T_R$ hours to allow the steel parts 3 to be martensitically transformed.

e) After completion of all operation aforementioned, the transfer apparatus 4 is pulled up to remove oil on the surface of the steel parts 3.

The quenching oil having high temperature is transferred to the heat exchanger 21 by the heat exchanger pump 22 shown in the attached drawing and cooled down to the predetermined temperature (about 150° C.). The quenching oil 6 is then circulated into the reservoir tank 2.

Specification of the Heat Exchanger

When a piece of steel of 230 kg/gross preheated 850° C. is dipped into the quenching oil (150° C.) of 7500 liters, temperature of the quenching oil raises to 157° C. and then can be cooled down to 150° C. by operating a multipipe heat exchanger of 4 $m^2$ for 20 minutes. 230 (k)×0.16 (kcal/kg.°C.)×(850−t) (°C.)=7400 (liters)×0.08 (specific gravity) ×0.53 (kcal/kg.°C.)×(t−150) (°C.) t=157.4 (°C.).

In the present invention, bubbles cannot be generated in the quenching oil 6 because mixing blades are not used to maintain the temperature of the quenching oil uniform. Further, quenching oil 6 kept at a constant temperature, for example approximately 160° C., can be supplied and allowed to flow upward around the steel parts 3 continuously at the predetermined rate.

The flow control valve 11 is closed when it is confirmed that the steel parts 3 are cooled down to 450° to 470° C. Consequently, quenching oil 6 in the quenching chamber 8 is reheated to a certain level by the heat released from the steel parts 3, and the steel parts 3 are contrarily cooled down to the predetermined temperature.

Further, should the steel parts 3 not cool down to the predetermined temperature as a result of closure of the flow control valve 11, the flow control valve 11 is opened once again so that quenching oil 6 is supplied until the steel parts 3 are cooled down to the predetermined temperature. Then, the steel parts 3, thus partially cooled to the predetermined temperature, are kept in the quenching chamber 8 to slowly cool down even further.

Furthermore, when supply of quenching oil 6 is stopped, the circulation pump 15 may be operated so as to circulate quenching oil 6 in the quenching chamber 8 in order to avoid the occurrence of temperature difference between the upper and lower parts of the quenching chamber 8.

Figure 6:
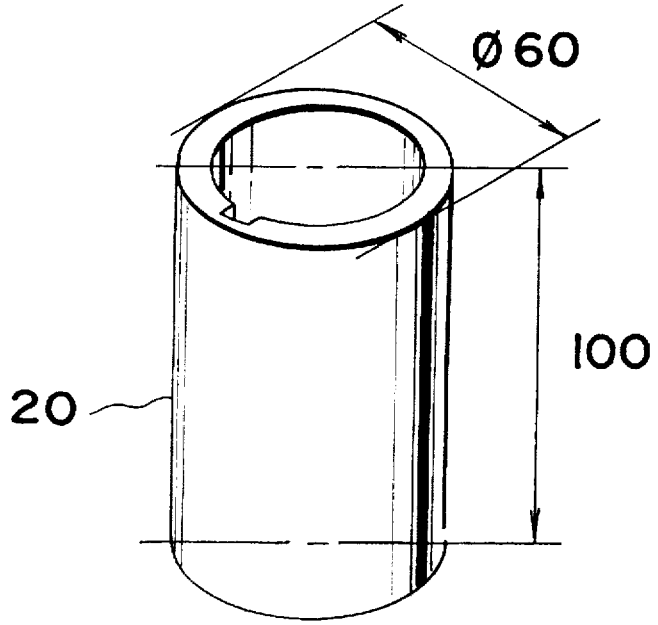
FIG. 6 is a perspective view showing a test piece.
Figure 7:
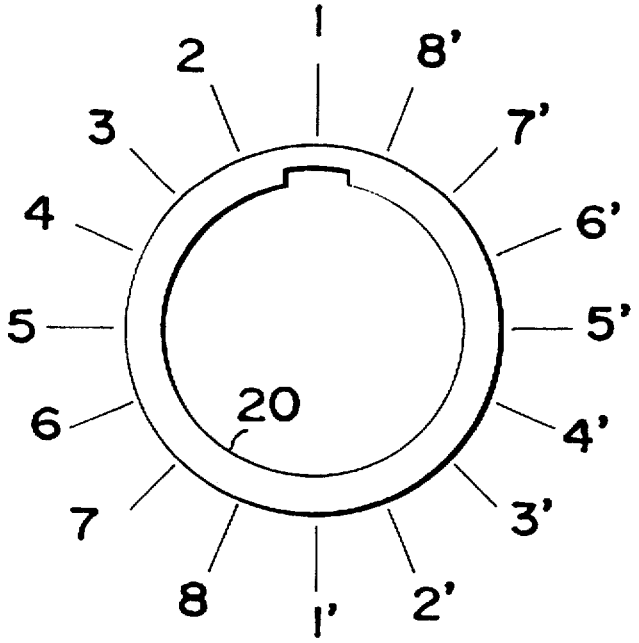
FIG. 7 is a plan drawing indicating each measurement position of the test piece.

Using a test piece 20, for example as shown in FIG. 6, a sleeve (100 mm in length and 60 mm in diameter) with a key gutter subjected to the same carburizing treatment, distortion of measurement was determined before and after various hardening. The results obtained are shown in the following Tables 1 and 2. FIG. 7 shows measurement points on said test piece 20. "Upper" and "Lower" in Tables 1 and 2 indicate the upper and the lower parts of the test piece 20 shown in FIG. 6, respectively.

The data shown in Table I were taken from the test piece 20 before and after hardening treatment by the apparatus shown in FIG. 1, and data shown in Table 2 were taken from the test piece 20 before and after hardening treatment by the apparatus shown in FIGS. 4 and 5.

According to Tables 1 and 2, the range of actual distortion in measurement at both the upper and lower parts of the test piece 20 was very small compared to each of the conventional methods. These results confirm that the present invention has superior effect in prevention of a change of the shape and a distortion of measurement of the steel parts which demonstrates that there is no variation in the treated layer. These facts also demonstrate that said method can be effectively implemented by the apparatus according to the present invention.

Various modifications and changes have been disclosed herein, and others will be apparent to those skilled in this art. Therefore, it is to be understood that the present disclosure is illustrative and not limiting of the present invention.

TABLE 1

Distortion after treatment (μ) (mean)

| Position | Conventional method Hot oil | | Conventional method Cold oil | | Present invention Semi-hot oil | |
|---|---|---|---|---|---|---|
| determined | Upper | Lower | Upper | Lower | Upper | Lower |
| 1 | −57 | −116 | 24 | 187 | −136 | −114 |
| 2 | −63 | −154 | 24 | 167 | −140 | −104 |
| 3 | −83 | −159 | 1 | 116 | −150 | −117 |
| 4 | −69 | −110 | 9 | 29 | −151 | −123 |
| 5 | −70 | −98 | 7 | 7 | −145 | −130 |
| 6 | −68 | −95 | 7 | 31 | −130 | −149 |
| 7 | −58 | −78 | 18 | 62 | −114 | −141 |
| 8 | −33 | −70 | 47 | 107 | −108 | −131 |
| Mean distortion ($\bar{x}$) | −62.6 | −110 | 17.1 | 88.3 | −134.3 | −126.1 |
| Maximum distortion (R) | 50 | 89 | 46 | 180 | 43 | 45 |
| Standard deviation (S) | 14.5 | 32.4 | 14.7 | 66.7 | 16.0 | 14.7 |

TABLE 1-continued

| Position determined | Distortion after treatment (μ) (mean) Conventional method Hot oil Upper | Lower | Conventional method Cold oil Upper | Lower | Present invention Semi-hot oil Upper | Lower |
|---|---|---|---|---|---|---|
| Standard deviation Within lot | 34.5 | | 59.4 | | 15.4 | |

TABLE 2

| Position determined | Distortion after treatment (μ) (mean) Conventional method Hot oil Upper | Lower | Conventional method Cold oil Upper | Lower | Present invention Semi-hot oil Upper | Lower |
|---|---|---|---|---|---|---|
| 1 | −57 | −116 | 24 | 187 | 4 | 6 |
| 2 | −63 | −154 | 24 | 167 | 6 | 8 |
| 3 | −83 | −159 | 1 | 116 | 29 | 22 |
| 4 | −69 | −110 | 9 | 29 | 46 | 40 |
| 5 | −70 | −98 | 7 | 7 | 49 | 42 |
| 6 | −68 | −95 | 7 | 31 | 46 | 36 |
| 7 | −58 | −78 | 18 | 62 | 31 | 13 |
| 8 | −33 | −70 | 47 | 107 | 4 | −3 |
| Mean distortion ($\bar{x}$) | −62.6 | −110 | 17.1 | 88.3 | 26.9 | 20.5 |
| Maximum distortion (R) | 50 | 89 | 46 | 180 | 45 | 45 |
| Standard deviation(S) | 14.5 | 32.4 | 14.7 | 66.7 | 19.7 | 17.2 |
| Standard deviation Within lot | 34.5 | | 59.4 | | 18.2 | |

What is claimed is:

1. Apparatus for quenching steel workpieces comprising:

a reservoir tank having an upper open top for containing quenching oil;

a quenching chamber having an open top disposed within said reservoir tank and an elevator, upon which said steel workpieces are loaded and movable vertically into and out of said quenching chamber, the level of said quenching oil in said reservoir tank being lower than the top of said quenching chamber to permit overflow of quenching oil from said quenching chamber to said reservoir tank, said quenching chamber being otherwise sealed from communication with said reservoir tank by a closed lower end, the size of the quenching chamber relative to the periphery of the elevator being as small as possible so as to immediately surround said steel workpieces while permitting free movement of the elevator in its vertical path;

means for supplying quenching oil into the quenching chamber adjacent the bottom thereof, comprising a conduit, a pump, and a valve arranged to create within said quenching chamber an upwardly moving laminar flow without agitation for movement of quenching oil through said steel workpieces to cool the same and means for operating said pump and valve to deliver said quenching oil through said conduit so that said quenching oil is calmed through a pooling effect and displaces said quenching oil at the bottom of the quenching chamber through volume displacement so that the quenching oil flows smoothly upwardly, layer by layer, as it is displaced; and the excess oil overflowing from the top of said quenching chamber into said reservoir tank.

2. The apparatus according to claim 1, wherein said conduit comprises a plurality of pipes, each pipe having an array of nozzles causing said quenching oil to impinge directly onto said closed lower end to create said laminar flow.

3. The apparatus according to claim 1, wherein the quenching chamber is open at both ends, the lower end being spaced from the bottom of said reservoir tank to provide a narrow passage therebetween, and wherein an auxiliary chamber surrounds the lower portion of said quenching chamber and the narrow passage, said auxiliary chamber having an inwardly directed upper wall sealed about the periphery of said quenching chamber, said auxiliary chamber being otherwise sealed from communication with said reservoir tank, and wherein the quenching oil is supplied into said auxiliary chamber said quenching oil passing into said quenching chamber through said narrow passage in the upwardly moving laminar flow.

4. The apparatus according to claim 3, wherein said means for supplying the quenching oil is arranged so as to impinge upon said inwardly directed wall prior to passage into said quenching chamber.

5. The apparatus according to claim 1, including means for circulating the quenching oil from the top of the quenching chamber to the bottom of said quenching chamber.

6. The apparatus according to claim 1, including means for circulating the overflowed quenching oil from the reservoir tank to the quenching chamber.

7. The apparatus according to claim 6, including means for cooling said circulating quenching oil.

8. A process for quenching steel workpieces comprising immersing the steel workpieces in a quenching chamber sealed on its sides and bottom within a reservoir tank, supplying quenching oil into the quenching chamber adjacent to the bottom thereof so as to create within said sealed quenching chamber an upwardly moving laminar flow through said steel workpieces to cool the same without agitation such that said quenching oil, as delivered, is calmed through a pooling effect and displaces the quenching oil at the bottom of the quenching chamber through volume displacement so that the quenching oil flows smoothly upwardly, layer by layer, as it is displaced, and permitting the excess oil overflowing from the top of said quenching chamber.

9. The process according to claim 8, wherein said supplying of quenching oil comprises impinging said quenching oil directly onto said bottom of said quenching chamber to create a laminar flow.

10. The process according to claim 8, wherein the quenching chamber comprises an auxiliary chamber having an inwardly directed upper wall and said supplying of quenching oil comprises impinging said quenching oil directly onto said inwardly directed upper wall to create a laminar flow.

11. The method according to claim 8, including circulating the quenching oil from the top of the quenching chamber to the bottom of said quenching chamber.

12. The method according to claim 8, including circulating the overflowed quenching oil from the reservoir tank to the quenching chamber.

13. The method according to claim 12, including cooling the circulating quenching oil.

* * * * *